US007464585B2

(12) United States Patent
Schwarz et al.

(10) Patent No.: US 7,464,585 B2
(45) Date of Patent: Dec. 16, 2008

(54) METHOD AND APPARATUS FOR SENSING INTEGRITY DEGRADATION IN TURBINE ENGINE COMPONENTS

(75) Inventors: Frederick Schwarz, Glastonbury, CT (US); C. Bruce Wood, Ellington, CT (US)

(73) Assignee: United Technologies Corporation, Hartford, CT (US)

( * ) Notice: Subject to any disclaimer, the term of this patent is extended or adjusted under 35 U.S.C. 154(b) by 282 days.

(21) Appl. No.: 11/186,095

(22) Filed: Jul. 21, 2005

(65) Prior Publication Data

US 2007/0089547 A1 Apr. 26, 2007

(51) Int. Cl.
*G01M 15/00* (2006.01)

(52) U.S. Cl. ..... 73/112.01

(58) Field of Classification Search ..... None
See application file for complete search history.

(56) References Cited

U.S. PATENT DOCUMENTS 3,691,820 A * 9/1972 Fiore ..... 73/40.7
3,795,147 A * 3/1974 Peterson et al. ..... 73/49.3
3,985,318 A 10/1976 Dominey et al.
4,026,660 A 5/1977 Ueda et al.
4,106,332 A 8/1978 McKeown
4,345,237 A 8/1982 Lerche et al.
4,524,620 A 6/1985 Wright et al.
4,727,251 A 2/1988 Blincow et al.
5,979,220 A * 11/1999 Zombo et al. ..... 73/23.2
6,387,706 B1 * 5/2002 Eden ..... 436/127
6,682,077 B1 * 1/2004 Letourneau ..... 277/412
2005/0122226 A1 * 6/2005 Treadway ..... 340/632
2005/0268595 A1 * 12/2005 Steyer et al. ..... 60/204

FOREIGN PATENT DOCUMENTS

JP 61-212753 * 9/1986

* cited by examiner

*Primary Examiner*—Robert R Raevis
(74) *Attorney, Agent, or Firm*—Bachman & LaPointe, P.C.

(57) ABSTRACT

A method for detecting integrity degradation of a turbine engine component includes the steps of detecting oxygen in a cavity of a turbine engine component; receiving a signal confirming the detection of oxygen; and detecting an integrity degradation of the turbine engine component by the detection of oxygen.

7 Claims, 2 Drawing Sheets

METHOD AND APPARATUS FOR SENSING INTEGRITY DEGRADATION IN TURBINE ENGINE COMPONENTS

FIELD OF USE

This invention relates to a method and apparatus for sensing integrity degradation and, more particularly, to a method and apparatus for sensing integrity degradation in turbine engine components.

BACKGROUND OF THE INVENTION

Presently, existing methods to detect and/or measure integrity degradation in blades and vanes of turbine engines do not effectively gauge the extent of or potential formation of integrity degradation, that is, a crack, without manually and/or visually inspecting the blades and vanes. One present method for detecting integrity degradation in a blade is limited to helicopters and their respective blades. Such methods concerning integrity degradation detection and their related apparatus, which all pertain to helicopter blades, are described in U.S. Pat. Nos. 3,985,318; 4,026,660; 4,106,332; 4,345,237; 4,524,620; and, 4,727,251.

However, one skilled in the art of turbine engines recognizes that helicopter blades are very long and slender as compared to typical aircraft blades and are subject to severe stress from flexing, bending, twisting, etc, which are different than stress experienced by turbine engine blades and vanes. Thus, the information contained in the aforementioned patents is useful for what is taught, but such information is not readily adaptable to the challenges and obstacles experienced when attempting to detect the extent of or potential formation of integrity degradation of turbine engine blades and vanes without manually and/or visually inspecting the turbine engine blades and vanes.

Consequently, there exists a need for a method and apparatus for detecting integrity degradation in turbine engine blades and vanes without manually and/or visually inspecting the blades and vanes.

SUMMARY OF THE INVENTION

In accordance with the present invention, a method for detecting integrity degradation in a turbine engine component broadly comprises detecting the presence of a second fluid in a cavity comprising a first fluid of a turbine engine component; receiving a signal confirming the detection of the second fluid; and detecting an integrity degradation of the turbine engine component by the detection of the second fluid.

In accordance with the present invention, a method for detecting integrity degradation of a turbine engine component broadly comprises detecting oxygen in a cavity of a turbine engine component; receiving a signal confirming the detection of oxygen; and detecting an integrity degradation of the turbine engine component by the detection of oxygen.

In accordance with the present invention, an apparatus for the detection of integrity degradation in a turbine engine component broadly comprises an oxygen detection sensor disposed within a turbine engine component; and a sensor signal collection device in communication with the oxygen detection sensor and disposed proximate to the turbine engine component.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

The method(s) and apparatus for detecting integrity degradation in a turbine engine component described herein generally utilize a second fluid detection sensor, for example, an oxygen sensor, disposed within, proximate to or exposed to a hollow cavity containing a first fluid within the turbine engine component and a sensor signal collection device. The combination of the second fluid detection sensor and sensor signal collection device provides at a minimum the following functions:

(a) the detection of a fluid at some minimum concentration foreign to the fluid originally sealed within the turbine engine component after manufacture;

(b) a self-powered attribute such that the second fluid detection sensor does not require wire connections or slip rings;

(c) a self-test attribute that verifies the second fluid detection sensor is operational whether or not the turbine engine is in service; and (d) wireless signal transmission attributes for both the second fluid detection sensor and the sensor signal collection device.

Figure 1:
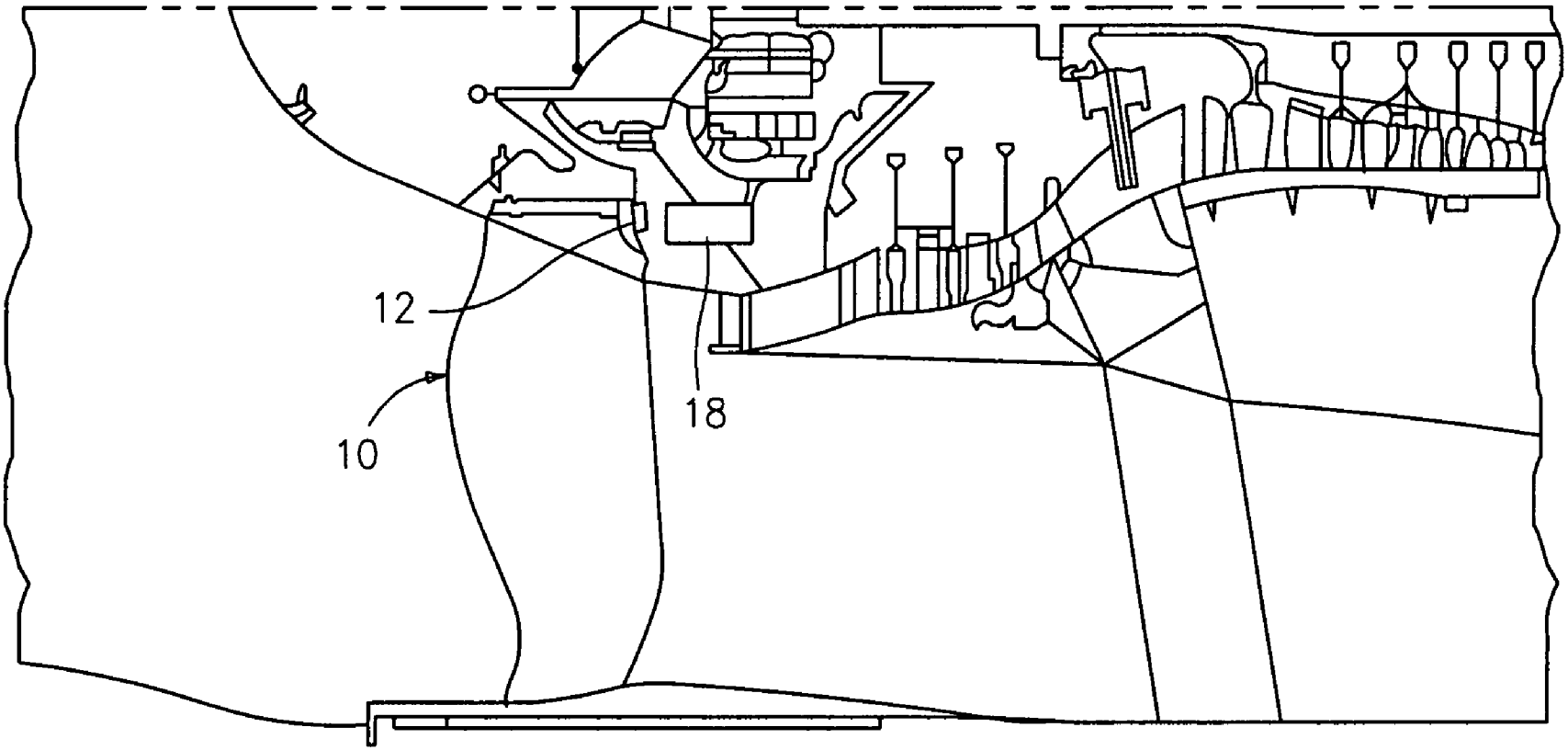
FIG. 1 is a representation of a cross-sectional view of a turbine engine compartment indicating a potential disposition of the sensor signal collection device with respect to the oxygen detection sensor.
Figure 2:
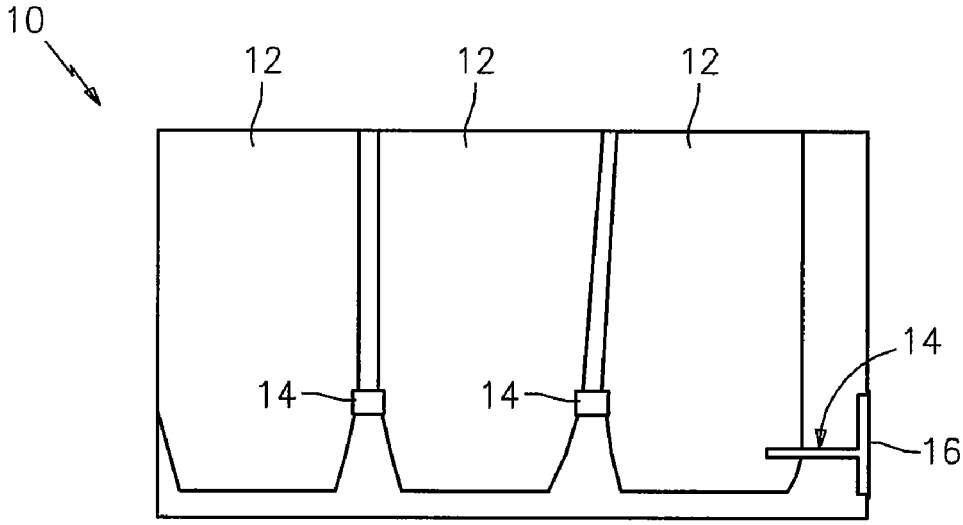
FIG. 2 is a representation of a cross-sectional view of a turbine engine blade tip fitted with an oxygen detection sensor exposed to a series of hollow cavities within the blade.
Figure 3:
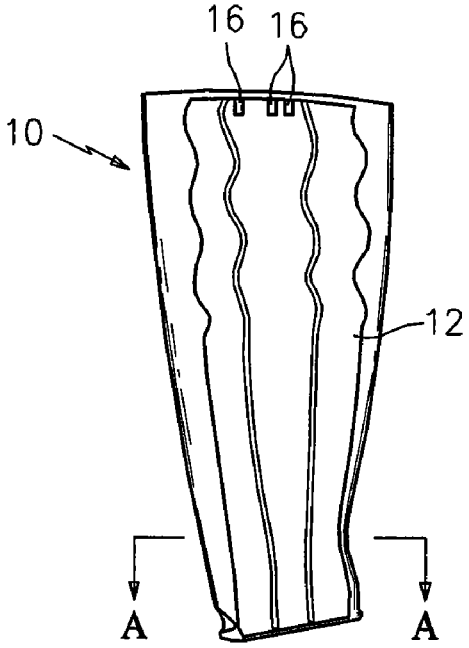
FIG. 3 is a representation of a cross-sectional view of a turbine engine blade fitted with several oxygen detection sensors in a root section that are exposed to a series of hollow cavities within the blade.
Figure 4:
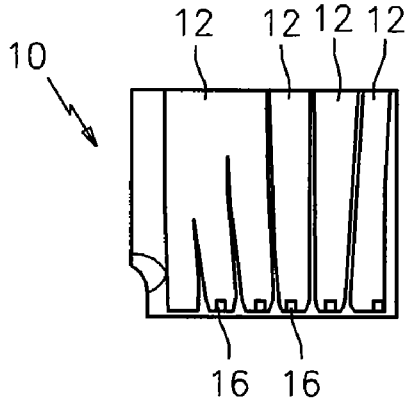
FIG. 4 is a representation of a section A-A of FIG. 3 depicting an alternative embodiment where oxygen detection sensors are disposed within each cavity formed by internal ribs of the turbine engine blade.
Figure 5:
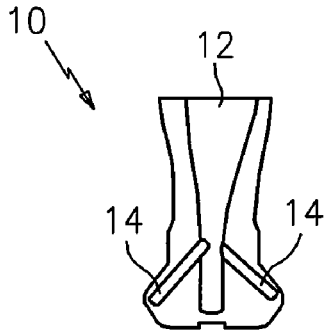
FIG. 5 is a representation of another alternative embodiment of FIG. 3 where oxygen detection sensors are disposed within channels formed within the cavity in the root section of the turbine engine blade.

Referring now to FIG. 1, a representative turbine engine compartment housing a turbine engine and various turbine engine components for purposes of describing the methods and apparatus of the present invention is shown. A turbine engine component is shown which may comprise a blade, a vane or any other turbine engine component that may experience integrity degradation. For purposes of the present application, integrity degradation generally means any degradation experienced by the structure of a turbine engine component that may allow the introduction of, in part or in whole, a second fluid into a hollow cavity of the turbine engine component and force the evacuation of a first fluid from the hollow cavity.

Referring generally now to FIGS. 2-5, a turbine engine blade 10 may comprise one or more hollow cavities 12, for example, multiple hollow cavities or a single hollow cavity divided by one or more internal integral geometry and the like, having one or more first channels 14 that expose a first fluid sealed within cavities 12 to one or more second fluid detection sensors 16. When blade 10 experiences integrity degradation, the first fluid evacuates and a second fluid fills the void within cavities 12 created by the absence of the first fluid. At that time, second fluid detection sensor 16 detects the presence of the second fluid within cavities 12. The presence of the second fluid may be detected once an amount of second fluid sufficient to be detected by second fluid detection sensor 16 enters cavities 12. Second fluid detection sensor 16 may be disposed within, proximate to or exposed to cavities 12 and the fluid(s) contained or introduced therein. Second fluid detection sensor 16 then transmits a signal to a sensor signal collection device 18 which processes the signal and transmits the data to another device or an interested party capable of receiving such data.

Second fluid detection sensor 16 may comprise a power source (not shown), means for self-testing (not shown) and means for wirelessly transmitting a signal (not shown). The power source may constitute a galvanic power source, for example, a galvanic battery commonly used for hearing aid devices. The means for self-testing may comprise a self-test electronic mechanism capable of registering, for example, chronologically, when a second fluid was ever detected whether or not the sensor 16, or even the turbine engine, was in use at the time. The means for wirelessly transmitting a signal may comprise any wireless technology capable of sending a signal containing the data collected by the sensor 16 to another device or interested party capable of receiving such data. In the alternative, sensor 16 may comprise a galvanic sensor or a zirconium based sensor, each further comprising means for self-testing and means for wirelessly transmitting a signal. As known to one of ordinary skill in the art, galvanic sensors generate electrical energy translated from chemical energy derived from a chemical reaction ignited by the presence of a sufficient amount of oxygen. The electrical energy generated is sufficient to self power the galvanic sensor, generate signals and transmit data. And, as known to one of ordinary skill in the art, zirconium sensors generally require a continuous power source capable of generating about 2 watts of power. The continuous power supply may comprise triggered electrical induction, harvested microwave energy, or harvested laser light from a transmitter mounted on a static structure within the turbine engine housing.

Sensor signal collection device 18 may comprise a means for receiving signals from second fluid detection sensor 16 and a means for transmitting a signal which notifies an interested party that the turbine engine component is experiencing integrity degradation. Means for receiving signals from second fluid detection sensor 16 may comprise a receiver (not shown) coupled to a signal processor (not shown), if necessary, to process the signal into a desired format for communicating the data from second fluid detection sensor 16. Means for transmitting a signal of device 18 may comprise any transmission technology capable of sending data to another device or interested party capable of receiving such data. Preferably, sensor signal collection device 18 is mounted to a stationary object, part and the like within the turbine engine housing or turbine engine itself.

The first fluid may comprise any fluid free of the second fluid, and the second fluid is a fluid other than the first fluid. For purposes of explanation, and not to be taken in a limiting sense, the second fluid may be oxygen in any fluid form, for example, air, and the first fluid may be any fluid entirely free of oxygen. And, the first fluid may comprise a noble gas such as argon. When the second fluid is oxygen, second fluid detection sensor 16 is preferably an oxygen detection sensor. However, second fluid detection sensor 16 may be designed to detect any fluid subject to the composition of the first fluid and the requirements of the intended application. Once second fluid detection sensor 16 detects the presence of a second fluid within cavities 12, sensor 16 transmits a signal to a sensor signal collection device 18 disposed proximate to blade 10 and in communication with sensor 16.

It is to be understood that the invention is not limited to the illustrations described and shown herein, which are deemed to be merely illustrative of the best modes of carrying out the invention, and which are susceptible to modification of form, size, arrangement of parts, and details of operation. The invention rather is intended to encompass all such modifications which are within its spirit and scope as defined by the claims.

What is claimed is:

1. A method for detecting integrity degradation of a turbine engine component, comprising:

detecting oxygen in a cavity of a turbine engine component by an oxygen detection sensor disposed within said cavity;

receiving a signal confirming said detection of oxygen; and detecting an integrity degradation of said turbine engine component by said detection of oxygen.

2. The method of claim 1, wherein said detection of oxygen comprises:

evacuating a noble gas within said cavity through the introduction of an amount of oxygen; and detecting said amount of oxygen using said oxygen detection sensor.

3. The method of claim 2, wherein said noble gas is argon.

4. The method of claim 1, wherein said reception comprises receiving said signal from a sensor signal collection device in communication with said oxygen detection sensor and disposed proximate to said turbine engine component.

5. An apparatus for the detection of integrity degradation in a turbine engine component, comprising:

an oxygen detection sensor disposed within a cavity of a turbine engine component; and a sensor signal collection device in communication with said oxygen detection sensor and disposed proximate to said turbine engine component, wherein said oxygen detection sensor comprises any one of the following:

a power source, means for self-testing and means for wirelessly transmitting a signal, or a galvanic sensor comprising means for self-testing and means for wirelessly transmitting a signal, or a zirconium based sensor comprising means for self-testing and means for wirelessly transmitting a signal.

6. The apparatus of claim 5, wherein said turbine engine component is a blade or a vane.

7. The apparatus of claim 5, wherein said sensor signal collection device comprises means for receiving signals from said oxygen detection sensor and means for transmitting a signal.

* * * * *